US007753723B2

(12) United States Patent
Ting

(10) Patent No.: US 7,753,723 B2
(45) Date of Patent: Jul. 13, 2010

(54) STACKED CARD CONNECTOR

(75) Inventor: Chien-Jen Ting, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/283,359

(22) Filed: Sep. 10, 2008

(65) Prior Publication Data

US 2009/0068882 A1 Mar. 12, 2009

(30) Foreign Application Priority Data

Sep. 10, 2007 (TW) ..... 96133658 A

(51) Int. Cl.
*H01R 13/60* (2006.01)
*H01R 13/66* (2006.01)

(52) U.S. Cl. ..... 439/541.5; 439/630; 439/607.31

(58) Field of Classification Search ..... 439/541.5, 439/159, 64, 630, 607.31, 607.32, 607.33
See application file for complete search history.

(56) References Cited

U.S. PATENT DOCUMENTS 5,954,522 A * 9/1999 Ho et al. ..... 439/79
6,045,366 A * 4/2000 Motomu ..... 439/64
6,062,904 A * 5/2000 Oguchi et al. ..... 439/541.5
6,238,240 B1 * 5/2001 Yu ..... 439/541.5
7,063,539 B2 * 6/2006 Ho et al. ..... 439/64
7,101,227 B2 * 9/2006 Kuo ..... 439/630
7,207,810 B2 * 4/2007 Kuo et al. ..... 439/79
7,510,414 B2 * 3/2009 Yu et al. ..... 439/159
2006/0178045 A1 * 8/2006 Ting ..... 439/541.5
2006/0286835 A1 * 12/2006 Cheng et al. ..... 439/159
2007/0259546 A1 * 11/2007 Ting ..... 439/159
2008/0299807 A1 * 12/2008 Ting ..... 439/159
2009/0068868 A1 * 3/2009 Ting ..... 439/159

* cited by examiner

*Primary Examiner*—Hae Moon Hyeon
(74) *Attorney, Agent, or Firm*—Andrew C. Cheng; Wei Te Chung; Ming Chieh Chang

(57) ABSTRACT

A card connector comprises an insulating housing comprising a base and a plurality of tongue portions extending from the base; a shell covering the insulating housing; a plurality of contacts arranged in upper and lower line each retained on the housing; the contacts each comprising a contacting portion extending into the mating portion, a containing portion secured in the housing, and a soldering portion extending behind the housing; a spacer and a Printed Circuit Board (PCB) each mounted on the insulating housing and the soldering portion of the contacts each receiving in the spacer and the PCB; the distance between the soldering portions of the upper and the lower contacts is smaller than that of the containing portions.

17 Claims, 5 Drawing Sheets

STACKED CARD CONNECTOR

BACKGROUND OF THE INVENTION

1. Field of the Invention

The present invention is generally related to a card connector, and especially to a card connector adapted for receiving electrical cards.

2. Description of Related Art

At present, electrical cards are widely used in electrical appliances to accomplish signal transmission or signal storage function. Certainly, card connectors are indispensable for receiving the corresponding electrical cards. With requirements of larger capacity of the electrical appliances, on one hand, enlarging capacity of the electrical cards themselves; on the other hand, adding quantities of the card connectors in the electrical appliances to receive more electrical cards. Thus, a card connector adapted for receiving cards arises.

U.S. Pat. No. 6,238,240 discloses a stacked card connector. The stacked card connector comprises a first card connector, a second card connector, each connector includes a row of upper terminals and a row of lower terminals. A spacer defines passageways for accommodating the mounting portions of the terminals. The spacer is inserted into a connector mounted on a mother board.

However, elements of the stacked card connector are excessive so that increasing manufacturing and assembling cost.

Hence, an improved card connector is highly desired to overcome the aforementioned disadvantages of the prior art.

SUMMARY OF THE INVENTION

Accordingly, an object of the present invention is to provide a card connector which has secure and simple structures.

To achieve the above object, a card connector comprises an insulating housing comprising a base and a plurality of tongue portions extending from the base with receiving channels formed thereon; a shell covering the insulating housing; a plurality of contacts arranged in upper and lower line each retained on the housing from a rear face to electrically connect with the corresponding electrical card; and the contacts each comprising a contacting portion extending into the mating portion, a containing portion interferentially secured in the housing, and a soldering portion extending behind the housing; a spacer and a Printed Circuit Board (PCB) each mounted on the insulating housing and the soldering portion of the contacts each receiving in the spacer and the PCB; the distance between the soldering portions of the upper and the lower contacts is smaller than that of the containing portions.

Other objects, advantages and novel features of the present invention will be drawn from the following detailed description of a preferred embodiment of the present invention with attached drawings.

DETAILED DESCRIPTION OF THE INVENTION

Reference will now be made in detail to the preferred embodiment of the present invention.

Figure 1:
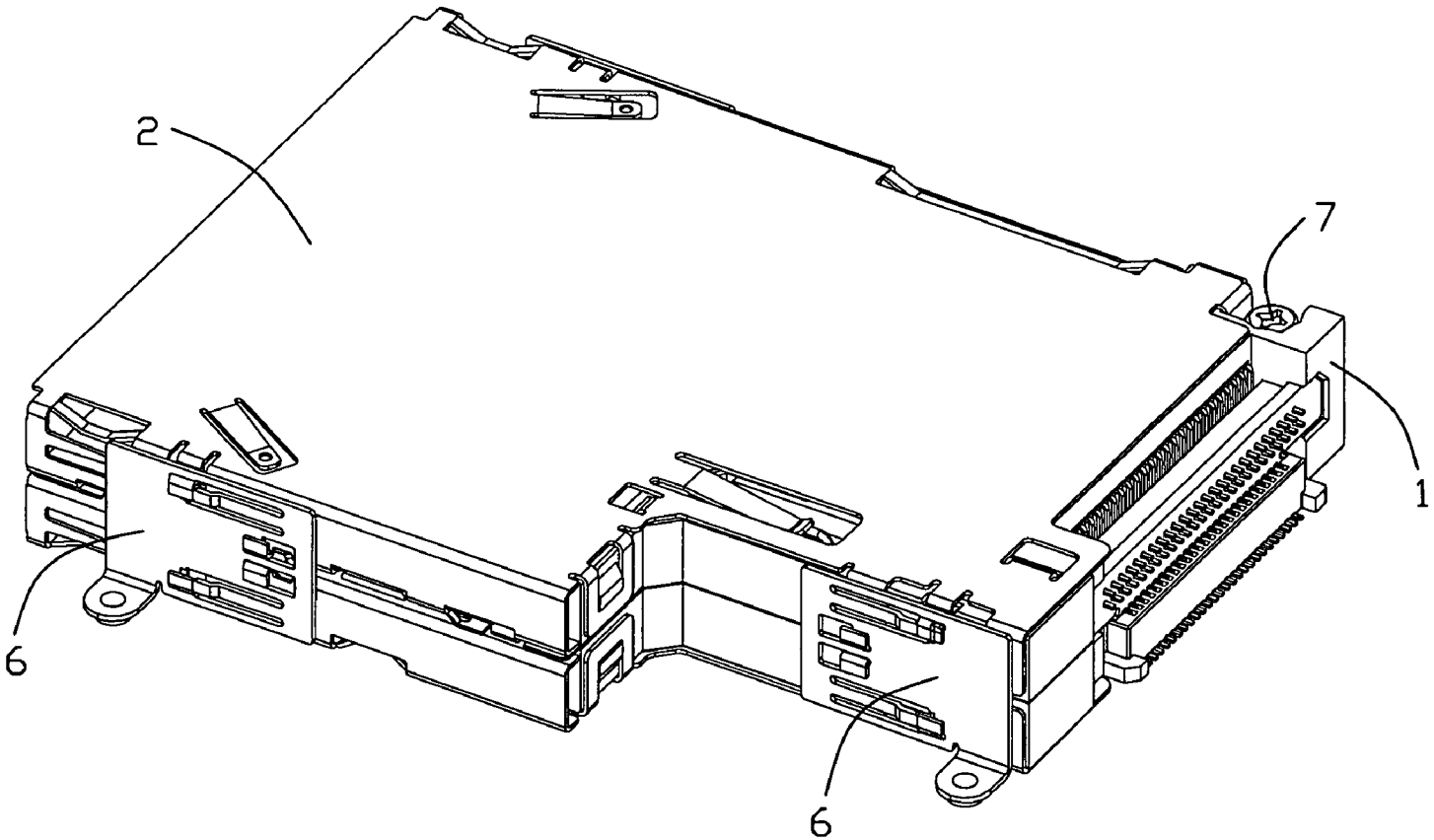
FIG. 1 is a perspective view of the card connector in accordance with the present invention.
Figure 2:
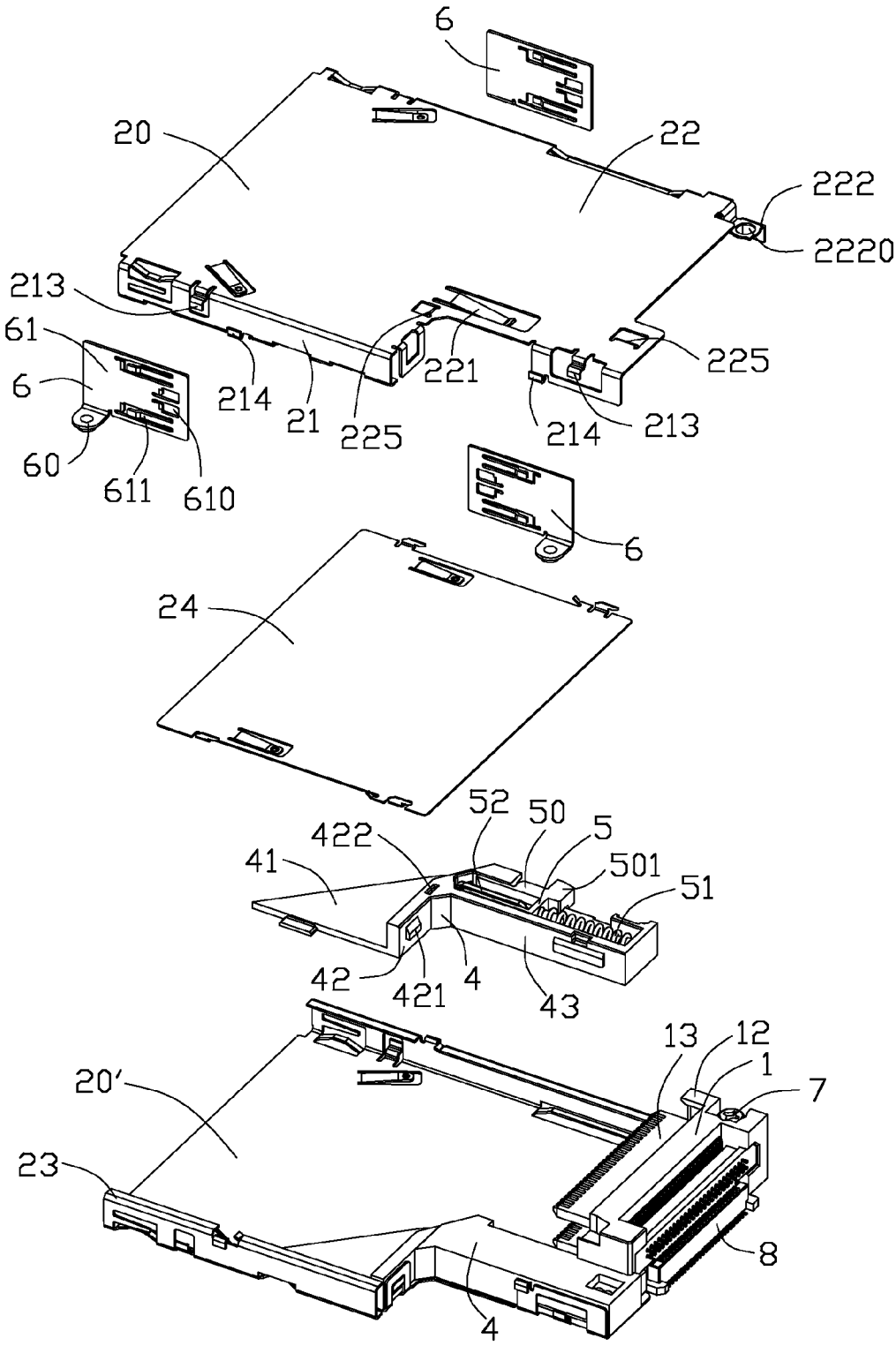
FIG. 2 is an exploded, perspective view of the card connector of FIG. 1.
Figure 3:
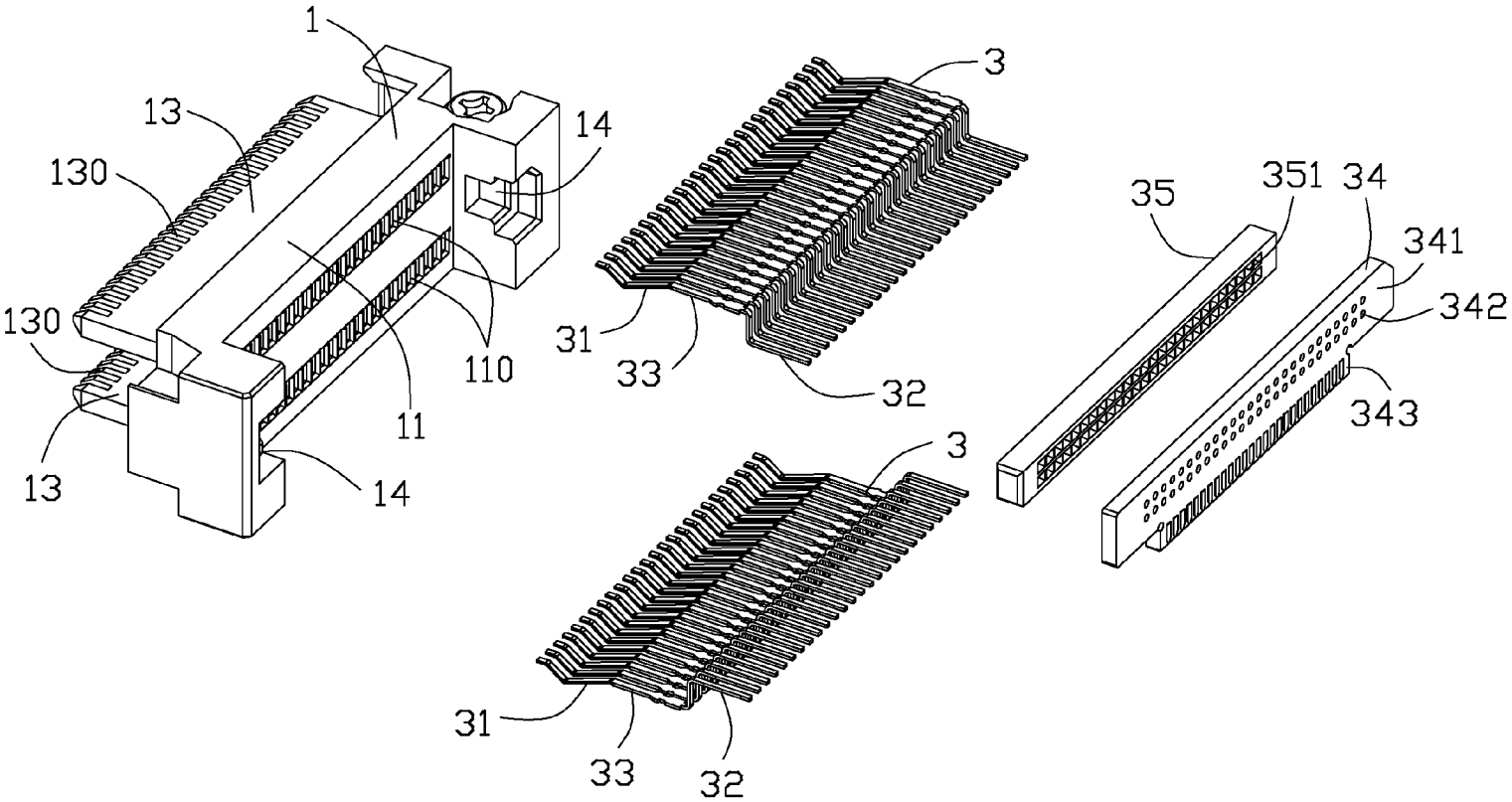
FIG. 3 is a perspective view of the insulating housing and contacts of the card connector of FIG. 1.
Figure 4:
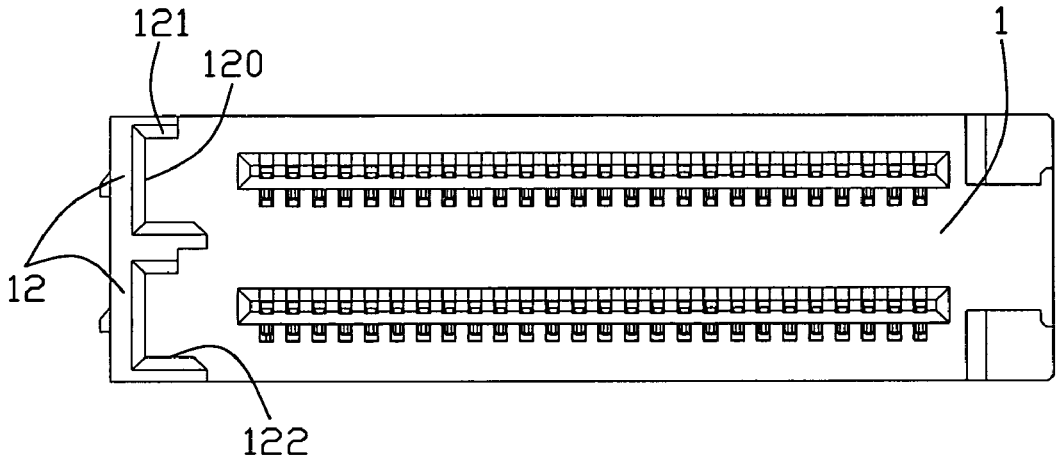
FIG. 4 is a front elevation view of the insulating housing of the prevent invention with contacts assembled thereon.

Referring to FIGS. 1-3, the card connector in accordance with the present invention is adapted for receiving two electrical cards. The card connector comprises an elongated insulating housing 1, a plurality of contacts 3 received in the insulating housing 1, shells 2 covering the insulating housing 1 to form a card receiving space, and a plurality of standoff devices 6 for mounting the card connector on a PCB (a mother board, not figured).

The elongated insulating housing 1 comprises a base 11, a pair of tongue-type mating portions 13 extending forwardly from the base 11 in stacked manner. The mating portions 13 are exposed in the card receiving space and arranged in an upper and lower position and spaced from each other. Each mating portion 13 defines a plurality of receiving channels 130 respectively for receiving the contacts 3. The base 11 defines a plurality of passages 110 each communicating with the corresponding receiving channels 130 and running through the base 11. Two receiving slots 14 are formed on two sides of the base 11.

Figure 5:
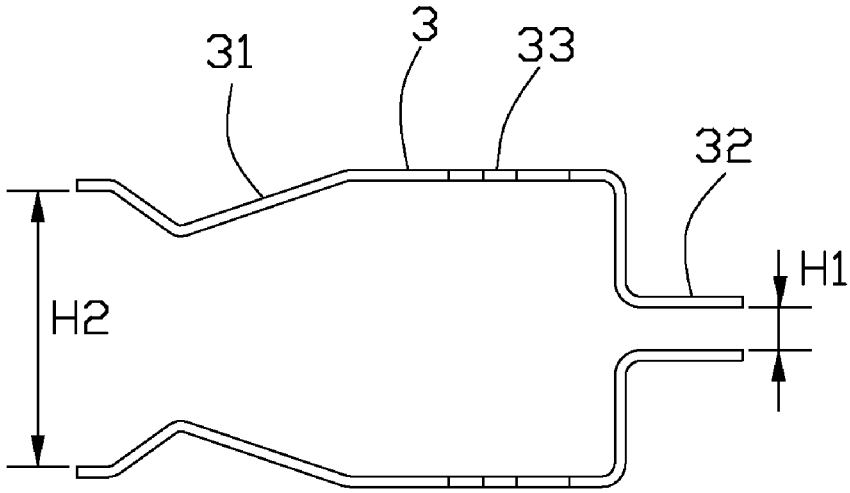
FIG. 5 is a side view of one upper contact and one lower contact of the card connector of the prevent invention.

Referring to FIGS. 1 and 3, the contacts 3 are grouped with upper contacts and lower contacts corresponding to the mating portions 13. Each upper and lower contact respectively comprises a contacting portion 31 extending into the mating portion, a containing portion 33 extending backwardly from the contacting portions 31 respectively, and interferentially secured in the housing, a soldering portion 32 extending backwardly from the containing portion 33 respectively, an elongated receiving spacer 35 and a PCB 34 (a daughter board) are mounted on the receiving slots 14 for receiving the soldering portion 32 respectively. The elongated receiving spacer 35 with a plurality of holes therethrough has a height shorter than the insulating housing. The contacting portions 31 and corresponding containing portions 33 of the upper contacts are located at an upper level and the contacting portions 31 and corresponding containing portions 33 of the lower contacts are located at a lower level. The soldering portion 32 is bent perpendicularly to the containing portions 33 and extends backwardly. As shown in FIG. 5, the distance H1 between the soldering portions 32 of the upper and the lower contacts 3 is small than that H2 of the containing portions 33. The PCB 34 has an upper portion 341 defining a plurality of through holes 342 for receiving the soldering portions 32 of the upper contacts and the lower contacts. A lower portion 343 is formed on the PCB 34 (daughter board) at the lower level is inserted to and received in a socket or an auxiliary connector 8 which is mounted on the mother board to establish an electrical connecting between the card and the mother board. The height of the PCB 34 is smaller than that of the insulating housing 1.

Referring to FIGS. 1 and 2, the shell 2 comprises an upper shell 20, a bottom shell 20' and a middle shell 24. The upper shell 20 and the bottom shell 20', each is formed in L-shape respectively, and are mounted on opposite faces of the insulating housing 11 in a symmetrical manner respect to the middle shell 24. The middle shell 24 is situated between the upper shell 20 and the bottom shell 20' by the stabs locking (not labeled) in the fastening gaps of the upper and bottom shells. A first and a second card receiving spaces are formed between the shells and the tongue-portions 13 extending into the spaces respectively. The upper shell 20 has a main portion 22, a pair of side wall 21 extending perpendicular to the main portion 22 and a pair of bottom edge 23 each extends inwardly from the side wall 21. Engaging tabs 213, 214 and 225 are formed on the side wall 21 and the main portion 22 respectively, and an engaging portion 222 is extending frontwardly from one side of the main portion 22. A screw hole 2220 is formed on the engaging portion 222 for receiving a screw 7 and mounted the connector on the PCB (mother board).

A guiding base 4 is covered by the upper shell 20 with a first ejecting mechanism 5 formed thereon. The guiding base 4 is formed in L-shape and comprises a triangle guiding portion 41, a vertical portion 42 extending vertically from a front edge of the guiding portion 41, an embossment 421 and an engaging hole 422 are formed on the vertical portion 42 respectively for engaging with the shell. An elongated portion 43 is extending from the triangle portion 41 with a receiving slot formed thereon for receiving the ejecting mechanism 5. The ejecting mechanism 5 comprises an ejector 50 having an ejecting portion 501 extending into the card receiving space, a spring portion 51 receiving in the receiving slot and connecting with the ejector 50, a cam follower 52 being fastened on the elongated portion 43 and connecting with the ejector 50. Furthermore, the bottom shell 20' also receive a guiding base, and two bases 4 are formed in symmetrical manner, the first ejecting mechanism 5 and a second ejecting mechanism (not figured) are placed in a symmetrically manner respect to the middle shell 24.

Referring to FIGS. 1 and 2, each standoff device 6 is disposed on a side of the shell 2. The standoff device 6 comprises a locking body 61 locking on the shell 5 and a holding body 60 extending perpendicularly to the locking body 61 for mounting on the printed circuit board (not shown). A bolt hole is defined in the holding body 60 for mounting the connector on the mother board. A plurality of receiving slots 610 are formed on the locking body 61 for receiving the engaging tabs 213, 214 respectively to engaging the upper shell 20 and the bottom shell 20' on the standoff device 6 together. On the other hand, solder tails of both the upper contacts and the lower contacts horizontally extend rearwardly and close with each other in a vertical direction, and are essentially located between the upper level and the lower level. In addition, a space occupied by the solder tails of all the upper contacts and that occupied by the solder tails of all the lower contacts are essentially aligned with each other in the vertical direction, and both the solder tails of the upper contacts and those of the lower contacts terminate at a same position in a front-to-back direction perpendicular to said vertical direction.

In this invention, each pair of contacts 3 received in different mating portions 13 are assembled on the tongue portions formed on one housing in stacked manner, thus provide a card connector which has secure and simple structures, and is assembled easily. Further more, the shells mounted on the housing in a symmetrical manner, the guiding base and the ejecting mechanism received in the shell in a symmetrical manner, which make assembly easily.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector adapted for receiving electrical cards, comprising:

an insulating housing comprising a base and a plurality of tongue portions extending from the base with receiving channels formed thereon;

a shell covering the insulating housing, the shell comprising an upper shell and a bottom shell each formed in L-shape and mounted on opposite faces of the insulating housing in a symmetrical manner;

a plurality of contacts arranged in upper and lower line each retained on the housing from a rear face to electrically connect with the corresponding electrical card; and the contacts each comprising a contacting portion extending into a mating portion, a containing portion interferentially secured in the housing, and a soldering portion extending behind the housing;

a spacer and a printed circuit board (PCB) each mounted on the insulating housing and the soldering portion of the contacts each receiving in the spacer and the PCB;

wherein the distance between the soldering portions of the upper and the lower contacts is smaller than that of the containing portions.

2. The card connector as described in claim 1, wherein the base has receiving slots formed on two sides for receiving the spacer.

3. The card connector as described in claim 2, wherein the spacer has a height shorter than the insulating housing.

4. The card connector as described in claim 3, wherein the tongue portions extending from the base and formed in stacked manner.

5. The card connector as described in claim 1, wherein a middle shell is formed between the upper and the bottom shell.

6. The card connector as described in claim 5, wherein the upper and the bottom shell each has side walls, a plurality of standoff devices each mounted on a side of the shell and engaging with the upper and the bottom shell together.

7. The card connector as described in claim 5, wherein a guiding base formed in L-shape is received in the shell, the guiding base comprises a triangle guiding portion, a vertical portion and an elongated portion extending from the triangle guiding portion.

8. The card connector as described in claim 7, wherein a receiving slot is formed on the elongated portion for receiving an ejecting mechanism.

9. The card connector as described in claim 8, wherein the ejecting mechanism comprises an ejector having an ejecting portion, a spring portion receiving in the receiving slot and connecting with the ejector, a cam follower being fastened on the elongated portion and connecting with the ejector.

10. The card connector as described in claim 9, wherein a first and a second guiding bases and ejecting mechanisms each receiving in an upper and bottom shell respectively and are placed in a symmetrically manner respect to the middle shell.

11. An electrical connector assembly comprising:

upper and lower connector units stacked with each other;

an insulative housing unit retaining upper contacts of the upper connector unit and lower contacts of the lower connector unit;

the upper contact defining an upper contacting section at an upper level, the lower contact defining a lower contacting section at a lower level while solder tails of both said upper contacts and said lower contacts horizontally extending rearwardly and close with each other in a vertical direction, and being essentially located between the upper level and the lower level under condition a space occupied by the solder tails of all said upper contacts and that occupied by the solder tails of all said lower contacts are essentially aligned with each other in said vertical direction, and both said solder tails of the upper contacts and those of said lower contacts terminate at a same position in a front-to-back direction perpendicular to said vertical direction;

an auxiliary connector located at the lower level; and a daughter board having an upper portion between the upper level and the lower level to securely receive the corresponding solder tails of both said upper and lower contacts, and a lower portion at the lower level to be received in the auxiliary connector; wherein the housing unit is equipped with a spacer with through holes through which said solder tails extend before said solder tails reach the daughter board.

12. The electrical connector assembly as claimed in claim 11, wherein both said daughter board and said spacer are engaged with the housing unit under a condition that said spacer is hidden behind the daughter board in a rear view.

13. The electrical connector assembly as claimed in claim 11, wherein said housing is unitary of one piece.

14. An electrical connector assembly comprising:

upper and lower connector units stacked with each other;

a unitary one piece insulative housing unit retaining upper contacts of the upper connector unit and lower contacts of the lower connector unit;

the upper contact defining an upper contacting section at an upper level, the lower contact defining a lower contacting section at a lower level while solder tails of both said upper contacts and said lower contacts horizontally extending rearwardly and being essentially located above the lower level under condition that a space occupied by the solder tails of all said upper contacts and that occupied by the solder tails of all said lower contacts are essentially aligned with each other in a vertical direction, and both said solder tails of the upper contacts and those of said lower contacts terminate at a same position in a front-to-back direction perpendicular to said vertical direction;

an auxiliary connector located at the lower level; and a daughter board having an upper portion above the lower level to securely receive the corresponding solder tails of both said upper and lower contacts, and a lower portion at the lower level to be received in the auxiliary connector; wherein said housing defines in a rear face a pair of receiving slots located at a mid-level between said upper level and said lower level, and each of said receiving slots receives a corresponding lateral side of the daughter board at an outer position of said slot to retain said daughter board to the housing.

15. The electrical connector assembly as claimed in claim 14, wherein the upper contacting sections of the upper contacts and the lower contacting sections of the lower contacts extend forwardly in a same manner while the solder tails of the upper contacts and the solder tails of the lower contacts rearwardly in a symmetrical manner.

16. The electrical connector assembly as claimed in claim 14, wherein the housing unit is equipped with a spacer with through holes through which said solder tails extend before said solder tails reach the daughter board, and each of said receiving slots further receives another corresponding sides of the spacer at an inner position of said slot behind said outer position to retain said spacer to the housing.

17. The electrical connector assembly as claimed in claim 16, wherein each of said receiving slots defines a stepped structure therein for respectively receiving the corresponding lateral side of the daughter board and that of the spacer.

* * * * *